United States Patent [19]

Burroughs et al.

[11] 4,171,061

[45] Oct. 16, 1979

[54] CONTAMINATION-PREVENTING CLOSURE

[75] Inventors: Harold R. Burroughs; Willie E. Martin; Vernon J. Jordan, all of Baton Rouge, La.

[73] Assignee: Allied Chemical Corporation, Morris Township, Morris County, N.J.

[21] Appl. No.: 883,777

[22] Filed: Mar. 6, 1978

[51] Int. Cl.[2] ..... B65D 51/18

[52] U.S. Cl. ..... 220/256; 105/377

[58] Field of Search ..... 220/256–258, 220/350, 366, 371; 105/377; 150/0.5; 114/201 R, 203

[56] References Cited

U.S. PATENT DOCUMENTS

| | | | |
|---|---|---|---|
| 2,104,540 | 1/1938 | Hoffman | 220/256 X |
| 3,570,703 | 3/1971 | MacRae | 220/256 |

*Primary Examiner*—George T. Hall

*Attorney, Agent, or Firm*—Alan M. Doernberg; Jay P. Friedenson

[57] ABSTRACT

A closure including a rigid thermoplastic member with a horizontally extending first portion occupying a major portion of the cross-sectional area within the loading aperture which is surrounded by the loading member of the hopper car, a second portion extending upwardly from the first portion which is inwardly adjacent of the interior of the loading member and a third portion extending outwardly from the second portion and overlaying the top of the loading member and underlaying the hatch cover of the hopper car when the hatch cover is in its closed position. Also a flexible plastic member overlaying the rigid thermoplastic member and the loading member and underlaying the hatch cover when the hatch cover is in its closed position.

8 Claims, 4 Drawing Figures

CONTAMINATION-PREVENTING CLOSURE

BACKGROUND OF THE INVENTION

High purity products are conventionally shipped in bulk in hopper cars whose housing includes an upwardly extending loading member defining therewithin a large cross-sectional loading aperture which communicates with the interior of the hopper car. Such hopper cars are provided with a hatch cover fittable over the loading member in a closed position covering the loading aperture. While such arrangement adequately protects many kinds of shipments during shipping, for high purity products, excessive amounts of dirt and other contamination enter through such an aperture. It is conventional to counteract this problem by placing a flexible plastic sheet or the like over the top of the loading member and beneath the hatch. Typically, such flexible sheet is fastened by an elastic member or the like pressing the flexible plastic sheet against the outside of the loading member and causing it to gusset and assume the general appearance of a shower cap.

Such a "shower cap" arrangement has the disadvantage that dirt and other contamination tend to accumulate on the top of the shower cap during loading and shipment such that, upon unloading, great care must be taken to prevent such contamination from falling into the hopper car through the loading aperture. This can occur when the flexible plastic sheet tears or when, in removing the flexible plastic sheet, dirt is permitted to fall from an edge of the flexible plastic sheet into the loading aperture. Since such apertures typically are of relatively large cross-sectional area, over a foot in diameter, such contamination of a shipment can occur in the absence of special care.

BRIEF DESCRIPTION OF THE INVENTION

Figure 1:
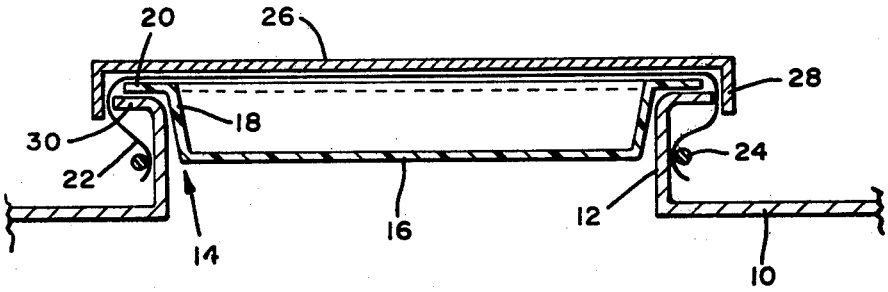
FIG. 1 is an elevational view in section of a closure according to a first embodiment of the present invention.

The present invention includes a contamination-preventing closure for a hopper car which includes a housing with an upwardly extending loading member defining therewithin a large cross-sectional loading aperture communicating with the interior of the hopper car and also includes a hatch cover fittable over the loading member in a closed position covering the loading aperture. The contamination-containing closure comprises a rigid member with a horizontally extending first portion occupying a major portion of the cross-sectional area within the loading aperture, a second portion extending upwardly from said first portion inwardly adjacent of the interior of the loading member and a third portion extending outwardly from said second portion and overlaying the top of the loading member and underlaying the hatch cover when the hatch cover is in its closed position, and also comprises a flexible plastic member overlaying the rigid member and the loading member and underlaying the hatch cover when the hatch cover is in its closed position.

DETAILED DESCRIPTION OF THE INVENTION

The present invention is directed to an improved closure which eliminates the problems of the prior art by providing both a flexible plastic member to seal off the loading aperture during shipment and a rigid thermoplastic member underlaying the flexible plastic member which catches any contamination entering the loading aperture. Accordingly, any failure of the flexible plastic sheet, either through tearing or through mistakes in unloading procedure, results merely in contamination reaching the main or first portion of the rigid thermoplastic member. Once the rigid thermoplastic member is removed, no dirt or other contamination remains within the loading aperture; nor has any of this contamination reached the interior of the hopper car housing.

In preferred forms of the invention, the rigid thermoplastic member defines at least one recess on its lower face adjacent its outer edge and adjacent the interior of the loading member. This recess acts to provide a portion of the contact surface between the thermoplastic insert and the loading member where no airtight seal may form. Accordingly, if temperature changes within the hopper car (such as occur on transportation to different climates) causes a pressure differential to develop across the insert, then this pressure drop may be overcome by passage of air through the recess. Otherwise, the insert could be sucked too tightly into the loading aperture. The presence of the recess facilitates breaking the seal on removal of the insert.

The closure of the present invention may be used for hopper cars in which the loading member includes at its top an outwardly extending flange portion and the hatch cover includes a downwardly extending flange portion fitable around the outwardly extending flange portion of the loading member. In such systems, it is preferred that the third portion of the rigid thermoplastic member overlay the outwardly extending flange portion of the loading member and that the flexible plastic member extend horizontally over the rigid thermoplastic member and the outwardly extending flange portion of the loading member, extend vertically downward outside the outermost portion of the outwardly extending flange portion of the loading member and within the downwardly extending flange portion of the hatch cover member.

The closure of the present invention may also be used with hopper cars in which the hatch cover is provided on its under-side adjacent its outermost portion with a recess and the uppermost portion of the loading member fits within the recess in the closed position. With such a hopper car, it is preferred that the third portion of the rigid thermoplastic member be within the recess overlaying the top of the loading member. In such a configuration, the top of the loading member may be in or beneath the recess.

Other aspects of the present invention may be determined from the following illustrated embodiments, which are not intended to limit the scope or spirit of the present invention as set forth in the claims that follow.

DESCRIPTION OF THE PREFERRED EMBODIMENTS

Referring to FIG. 1, a portion of a hopper car housing 10 is shown from which a loading member portion 12 of the housing extends upwardly defining therewithin a loading aperture. A rigid thermoplastic insert or member 14 nests within the loading aperture and against the loading member 12 as described below. The thermoplastic insert 14 may be of any conventional rigid thermoplastic or thermosetting material, but is preferably high density polyethylene. For simplicity, the material will be referred to as thermoplastic as is preferred. The thermoplastic insert 14 may also be provided with horizontally extending stiffening members, not shown, and the thickness of the portion may therefore be reduced without losing rigidity.

The rigid thermoplastic member 14, as shown in FIG. 1, includes a first or horizontally extending portion 16 which occupies a major portion (and preferably substantially the entire portion) of the cross-sectional area of the loading aperture defined by loading member 12. The first portion 16 sits in the nesting position within the loading aperture. A second portion 18 of the rigid thermoplastic member 14 extends upwardly and outwardly from the first portion 16 in the general configuration of a conical section. A third portion 20 extends outwardly from the topmost end of the second portion 18. The third portion 20 and the uppermost part of the second portion 18 are above the loading member 12, while the first portion 16 and the major portion of second portion 18 are within the loading aperture. The third portion 20 overlays the loading member 12 and may abut it. As illustrated, it is the tapered or second portion 18 that abuts against the loading member 12. A flexible plastic sheet 22 of any suitable plastic material such as polyethylene overlays the rigid thermoplastic member 14 and the loading member 12. As illustrated, it is fastened by an elastic member 24 against the outside of the loading member 12 assuming the general configuration of a "shower cap". The flexible plastic member or sheet 22 fits underneath the hatch 26 of the hopper car which, as illustrated in FIG. 1, is of the type having a downwardly extending flange portion 28 on its outside which fits around the outside of an outwardly extending flange portion 30 of the loading member 12. Such a configuration is sometimes referred to as a "type 1 hatch". It will be appreciated that in this configuration the flexible plastic member extends horizontally over the rigid thermoplastic member 14 and the loading member 12, extends vertically downward outside the outermost portion of the outwardly extending flange portion 30 of the loading member 12 and within the downwardly extending flange portion 28 of the hatch cover 26.

Figure 2:
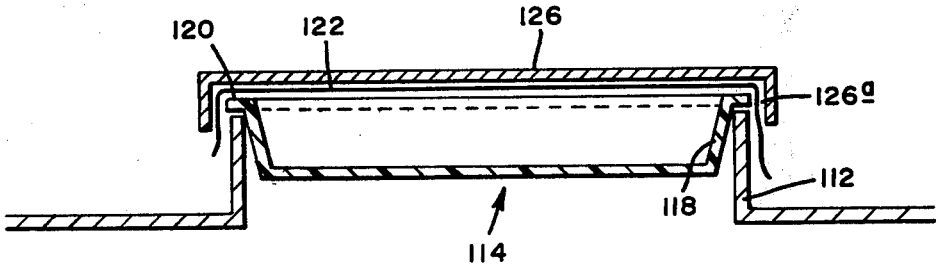
FIG. 2 is a view similar to FIG. 1 of closure according to a second embodiment of the present invention for a different type of hatch cover than the first embodiment.

As shown in FIG. 2, the closure of the present invention may be used in other types of conventional hatch arrangements such as the one illustrated which is sometimes referred to as a "type 2 hatch". In this arrangement, the hatch 126 is provided on its bottom face with an upwardly extending recess 126*a* adjacent its outermost portion. It will be appreciated that without any closure system, the top of the loading member 112 would fit within this recess 126*a*. With the closure of the present invention, the second portion 118 of the rigid thermoplastic member 114 extends from within the loading aperture into the recess 126*a*. The third portion 120 of the rigid thermoplastic member 114 extends vertically outward within the recess 126*a*. This third portion 120 overlays the top of the loading member 112. As illustrated, the recess 126*a* is sufficiently large for the top of the loading member 112 to still extend slightly into the recess. It will also be suitable for practice of the present invention, however, if the third portion 120 of the rigid thermoplastic member 114 occupied the entire vertical extent of the recess 126*a* and the loading member 112 was entirely below the recess 126*a*. The flexible plastic member 122 extends over the rigid thermoplastic member 114 and within the recess 126*a* between the third portion 120 of the rigid thermoplastic member 114 and the hatch 126, and then out of the recess 126*a*, outside of the outermost portion of the third portion 120 and the loading member 112.

Figure 3:
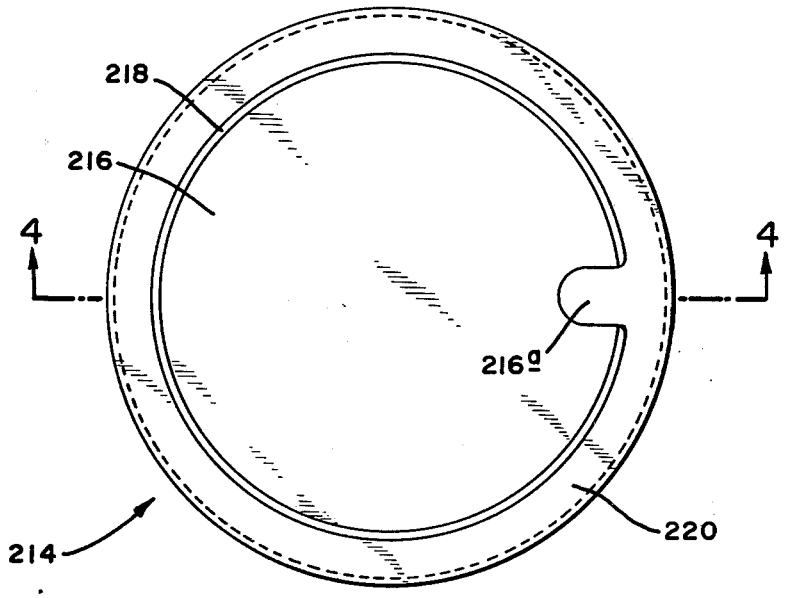
FIG. 3 is a plan view of a rigid thermoplastic insert according to a third embodiment of the present invention.
Figure 4:
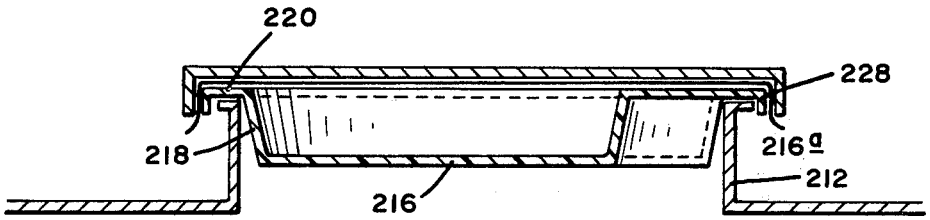
FIG. 4 shows an elevational view in section taken along line 4—4 of the rigid thermoplastic insert of FIG. 3, as installed in combination with a loading member and hatch cover.

Referring to FIG. 3, a modified thermoplastic insert or member 214 is shown having a first or horizontally extending portion 216, a second or diagonally extending portion 218 and a third or outwardly extending portion 220 (similar to portion 20 in FIG. 1). The first portion 216 and second portion 218 differ from corresponding elements of the previous embodiments only in defining together a recess 216*a* adjacent the outer edge of the thermoplastic member 214 along a small portion of its arc. As shown in FIG. 4, this recess provides an area of limited engagement between the thermoplastic member 214 and the loading member 212. Thus, the interior communicates through recess 216*a* with the exterior so that air may pass in either direction. A filter 230 is provided along this passage. This recess reduces the formation of a pressure differential across thermoplastic member 214 and facilitates breaking the seal.

The thermoplastic insert 214 is shown in FIG. 4 to have a flange portion 228 designed for a "type 1 hatch". It should be appreciated that the improved features of this third embodiment may be applied equally well to the closure system for a "type 2 hatch" as shown in FIG. 2.

The modified insert 114 or 214 may also be used to close a loading member without using a flexible member such as element 22 or 122.

The present invention is not, however, limited to the above-described embodiments, but may include many deletions, additions or modifications within the spirit and scope of the present invention as defined by the claims that follow.

What is claimed is:

1. A contamination-preventing closure for a hopper car which includes a housing with an upwardly extending loading member defining therewithin a large cross-sectioned loading aperture communicating with the interior of the hopper car and also includes a hatch cover fittable over the loading member in a closed position covering said loading aperture;

said contamination-containing closure comprising a rigid member with a horizontally extending first portion occupying a major portion of the cross-sectional area within the loading aperture, a second portion extending upwardly from the first portion inwardly adjacent of the interior of the loading member and a third portion extending outwardly from said second portion and overlaying the top of the loading member and underlaying the hatch cover when the hatch cover is in its closed position, and a flexible plastic member overlaying said rigid member and the loading member and underlaying the hatch cover when the hatch cover is in its closed position.

2. The closure of claim 1 wherein said rigid member defines at least one recess provided adjacent the interior of the loading member for pressure equalization between the interior of the hopper car and the exterior of the hopper car.

3. The closure of claim 2 wherein one such recess is defined by said second and third portions of said rigid member.

4. The closure of claim 1 wherein said second portion extends upwardly and outwardly from said first portion.

5. The closure of claim 1 wherein the loading member includes at its top an outwardly extending flange portion, the hatch includes at its outermost end a downwardly extending flange portion and said flexible plastic member extends horizontally over said rigid member and the outwardly extending flange portion of the loading member and then vertically downward outside the outermost portion of the outwardly extending flange portion of the loading member and within the downwardly extending flange portion of the hatch cover.

6. The closure of claim 1 wherein the hatch includes on its bottom face adjacent its outermost edge a recess sized to fittably receive the top of the loading member and wherein, in the closed position of the hatch cover, said third portion of said rigid member is received within the recess overlaying the top of the loading member.

7. The closure of claim 1 wherein said third portion includes horizontally extending stiffening elements.

8. A contamination-preventing closure for a hopper car which includes a housing with an upwardly extending loading member defining therewithin a large cross-sectioned loading aperture communicating with the interior of the hopper car and also includes a hatch cover fittable over the loading member in a closed position covering said loading aperture;

said contamination-containing closure comprising a rigid member with a horizontally extending first portion occupying a major portion of the cross-sectional area within the loading aperture, a second portion extending upwardly from the first portion inwardly adjacent of the interior of the loading member and a third portion extending outwardly from said second portion and overlaying the top of the loading member and underlaying the hatch cover when the hatch cover is in its closed position, said rigid member defining at least one recess provided adjacent the interior of the loading member for pressure equalization between the interior of the hopper car and the exterior of the hopper car.

* * * * *